US010801533B2

(12) United States Patent
Shimada

(10) Patent No.: US 10,801,533 B2
(45) Date of Patent: Oct. 13, 2020

(54) FLUID PRESSURE CIRCUIT

(71) Applicant: Eagle Industry Co., Ltd., Tokyo (JP)

(72) Inventor: Yoshiyuki Shimada, Tokyo (JP)

(73) Assignee: EAGLE INDUSTRY CO., LTD. (JP)

( * ) Notice: Subject to any disclaimer, the term of this patent is extended or adjusted under 35 U.S.C. 154(b) by 0 days.

(21) Appl. No.: 16/482,221

(22) PCT Filed: Feb. 6, 2018

(86) PCT No.: PCT/JP2018/003973

§ 371 (c)(1),
(2) Date: Jul. 30, 2019

(87) PCT Pub. No.: WO2018/147261

PCT Pub. Date: Aug. 16, 2018

(65) Prior Publication Data

US 2020/0040920 A1 Feb. 6, 2020

(30) Foreign Application Priority Data

Feb. 10, 2017 (JP) ..... 2017-023012

(51) Int. Cl.
*F15B 21/14* (2006.01)
*F15B 13/02* (2006.01)
*F15B 15/02* (2006.01)

(52) U.S. Cl.
CPC ..... *F15B 21/14* (2013.01); *F15B 13/022* (2013.01); *F15B 15/02* (2013.01)

(58) Field of Classification Search
CPC ..... F15B 21/14; F15B 13/022; F15B 15/02; F15B 11/044; E02F 9/22
See application file for complete search history.

(56) References Cited

U.S. PATENT DOCUMENTS 9,228,323 B2 * 1/2016 Kawasaki ..... E02F 9/2217
9,926,950 B2 3/2018 Ooki et al. ..... F16D 31/02
(Continued)

FOREIGN PATENT DOCUMENTS

CN 105221495 1/2016 ..... F15B 11/044
JP 2014029180 2/2014 ..... E02F 9/22
JP 2016014398 1/2016 ..... E02F 9/20

OTHER PUBLICATIONS

Chinese Official Action issued in related application serial No. 20188008907.9, dated Feb. 27, 2020 with English Translation (10 pages).

(Continued)

*Primary Examiner* — Thomas E Lazo
(74) *Attorney, Agent, or Firm* — Hayes Soloway P.C.

(57) ABSTRACT

A fluid pressure circuit for controlling a rod of a cylinder controlled in accordance with an operation command includes a tank, a fluid pressure actuator configured to pressurize fluid supplied from the tank for extending and retracting the cylinder, a flow control valve arranged between the fluid pressure actuator and the cylinder device configured to switch a flow passage of pressurized fluid and discharge via a first throttle return fluid from the cylinder, a variable regeneration switching valve configured to discharge return fluid from the cylinder to the flow control valve upon non-regeneration and upon regeneration, branch part of the return fluid and discharge via a second throttle the fluid branched, a regenerative motor configured for regeneration by fluid branched by the variable regeneration switching valve, and a third throttle connected in series with the first throttle upon the regeneration to limit flow of return fluid.

10 Claims, 11 Drawing Sheets

(56) References Cited

U.S. PATENT DOCUMENTS

| | | | | |
|---|---|---|---|---|
| 2011/0268588 | A1* | 11/2011 | Kawasaki | E02F 9/2296 417/213 |
| 2015/0152900 | A1* | 6/2015 | Egawa | E02F 9/2095 60/419 |
| 2015/0377264 | A1* | 12/2015 | Ooki | E02F 9/2285 60/403 |
| 2016/0215481 | A1* | 7/2016 | Kawasaki | E02F 9/2075 |
| 2016/0237648 | A1* | 8/2016 | Kawasaki | E02F 9/2075 |

OTHER PUBLICATIONS

International Preliminary Report on Patentability (w/translation) issued in application No. PCT/JP2018/003973, dated Aug. 13, 2019 (12 pgs).

International Search Report and Written Opinion (w/translation) issued in application No. PCT/JP2018/003973, dated May 15, 2018 (14 pgs).

* cited by examiner (a)

(b)

PRIOR ART

FLUID PRESSURE CIRCUIT

TECHNICAL FIELD

The present invention relates to a fluid pressure circuit that controls the rod stroke of a cylinder device in accordance with an operation command.

BACKGROUND ART

A fluid pressure circuit that controls the rod stroke of a cylinder device in accordance with an operation command is generally utilized in an operating machine, a construction machine, a cargo handling vehicle, an automobile, or the like. Energy saving is required even in the fluid pressure circuit, and there is proposed a conventional fluid pressure circuit configured to regenerate, by a hydraulic motor, fluid discharged from a cylinder device for driving a hydraulic motor so as to effectively utilize energy.

For example, with reference to FIG. 10, a fluid pressure circuit known as such a conventional fluid pressure circuit is configured such that when an operation lever 112*a* of a remote control valve 112 is operated in an extending direction A, a flow control valve 104 is switched to an extended position and pressure oil from a hydraulic pump 102 is introduced into a bottom chamber 105-1 of a cylinder device 105 to extend a rod 105*a* outside and such that when the operation lever 112*a* is operated in a retracting direction B, the flow control valve 104 is switched to a retracted position and the pressure oil from the hydraulic pump 102 is introduced into a rod chamber 105-2 to retract the rod 105*a* into the cylinder device 105.

Further, a branched oil passage 130 is branched from and connected to an oil passage 124 that connects the bottom chamber 105-1 to the flow control valve 104. When a variable regeneration switching valve 109 is operated to open, a portion of the return oil discharged from the bottom chamber 105-1 is supplied through the branched oil passage 130 to a hydraulic motor 110 to drive a generator 111 connected to the hydraulic motor 110. This results in the fact that part of energy of the return oil is recovered as electric energy (Patent Literature 1).

CITATION LIST

Patent Literature

Patent Literature 1: JP 2014-29180 A (page 6, FIG. 1)

SUMMARY OF INVENTION

Technical Problem

Here, when a capacitor has reached an allowable electricity storage amount during regeneration, a controller 114 causes the variable regeneration switching valve 109 to close; therefore, the supply of the return oil to the hydraulic motor 110 is cut and thus the generator 111 stops generating electricity. During regeneration, the closing of the variable regeneration, switching valve 109 allows a portion of the return oil to be discharged through a variable throttle Ab of the variable regeneration switching valve 109 to a tank 108 and the remaining return oil to be discharged through a variable throttle As of the flow control valve 104 to the tank 108. Meanwhile, during non-regeneration when the regeneration operation is stopped, the return oil is discharged only through the throttle As of the flow control valve 104 to the tank 108. In other words, when regeneration is switched to non-regeneration, the return oil is controlled only by C-T opening characteristics of the flow control valve 104. Consequently, as shown in FIG. 11, a rod retraction speed V of the cylinder device 105 suddenly changes and therefore operability of an operating machine or the like is not stable. In addition, a large impact force is generated to the cylinder device 105 and therefore the operability of the operating machine or the like may be adversely affected.

The present invention is thus made in view of the foregoing problem, and an object of the present invention is to provide a fluid pressure circuit that can smoothly control a rod of a cylinder device controlled in accordance with an operation command.

Solution to Problem

In order to solve the above problem, a fluid pressure circuit according to a first aspect of the present invention is configured to control a rod stroke of a cylinder device in accordance with an operation command. The fluid pressure circuit includes:

- a tank having a fluid stored therein;
- a fluid pressure actuator configured to pressurize the fluid supplied from the tank for extending and retracting the cylinder device;
- a flow control valve arranged between the fluid pressure actuator and the cylinder device and configured to switch a flow passage of the pressurized fluid and to discharge via a first throttle the fluid returned from the cylinder device;
- a variable regeneration switching valve configured to discharge the fluid returned from the cylinder device to the flow control valve upon non-regeneration of fluid energy and to, upon regeneration of the fluid energy, branch part of the fluid returned from the cylinder device and discharge via a second throttle the fluid branched;
- a regenerative motor configured to be driven for the regeneration by the fluid branched by the variable regeneration switching valve; and
- a third throttle configured to be connected in series with the first throttle upon the regeneration to limit flow of the fluid returned from the cylinder device.

According to the first aspect, in a state where the fluid is branched to be supplied to the regenerative motor, when the variable regeneration switching valve is switched from a position at the time of regeneration of the fluid energy to a position at the time of non-regeneration of the fluid energy, the opening area of the throttles affecting the returned fluid from the cylinder device is changed from a synthesized opening area in a state where the second throttle and the third throttle are in parallel connection with each other and the third throttle is connected in series with the first throttle, to a solo opening area in a state where the flow of the return fluid is limited by the first throttle. This means that a difference of the opening area of the throttles affecting the returned fluid from the cylinder device, between before and after the switching from the regeneration to the non-regeneration can be reduced. Consequently, a rod of the cylinder device can be smoothly controlled.

In the fluid pressure circuit according to a second aspect of the present invention, As>Ax>Ab, where As, Ab, and Ax are an opening area of the first throttle, an opening area of the second, throttle, and an opening area of the third throttle, respectively, for the operation command.

According to the second aspect, a difference between the opening area, at the time of regeneration and the opening area at the time of non-regeneration can be significantly reduced.

In the fluid pressure circuit according to a third aspect of the present invention, $Ax=As\cdot(As-Ab)/\sqrt{(Ab\cdot(2\times X As-Ab))}$, where As, Ab, and Ax are an opening area of the first throttle, an opening area of the second throttle, and an opening area of the third throttle, respectively, for the operation command.

According to the third aspect, the opening area at the time of regeneration can be substantially equal to the opening area at the time of non-regeneration.

In the fluid pressure circuit according to a fourth aspect of the present invention, the third throttle is provided separately from the flow control valve.

According to the fourth aspect, the third throttle can be set without depending on the configuration of the flow control valve that is configured to control the supply volume of the pressurized fluid to the cylinder device and the discharge volume of the return fluid from the cylinder device. Therefore, the third throttle can be applied to various flow control valves.

In the fluid pressure circuit according to a fifth aspect of the present invention, the third throttle is provided in the variable regeneration switching valve.

According to the fifth aspect, the return fluid is communicated with or blocked by the third throttle in accordance with switching of the variable regeneration switching valve. Therefore, in accordance with the switching operation of the variable regeneration switching valve, the function of the third throttle can be surely achieved.

In the fluid pressure circuit according to a sixth aspect of the present invention, when driving the regenerative motor, the flow control valve and the variable regeneration switching valve are simultaneously switched.

According to the sixth aspect, during regeneration by the regenerative motor, the regeneration is rarely finished. Therefore, the variable regeneration switching valve is rarely switched during the regeneration and thus the rod speed of the cylinder device can be smoothly controlled.

In the fluid pressure circuit according to a seventh aspect of the present invention, the flow control valve is a spool switching valve having six ports and three positions.

According to the seventh aspect, the third throttle may be set regardless of the configuration of a spool valve, which is superior in versatility.

BRIEF DESCRIPTION OF DRAWINGS

FIG. 7A shows the relationship at the time of regeneration and FIG. 7B shows the relationship at the time of non-regeneration.

DESCRIPTION OF EMBODIMENTS

Figure 1:
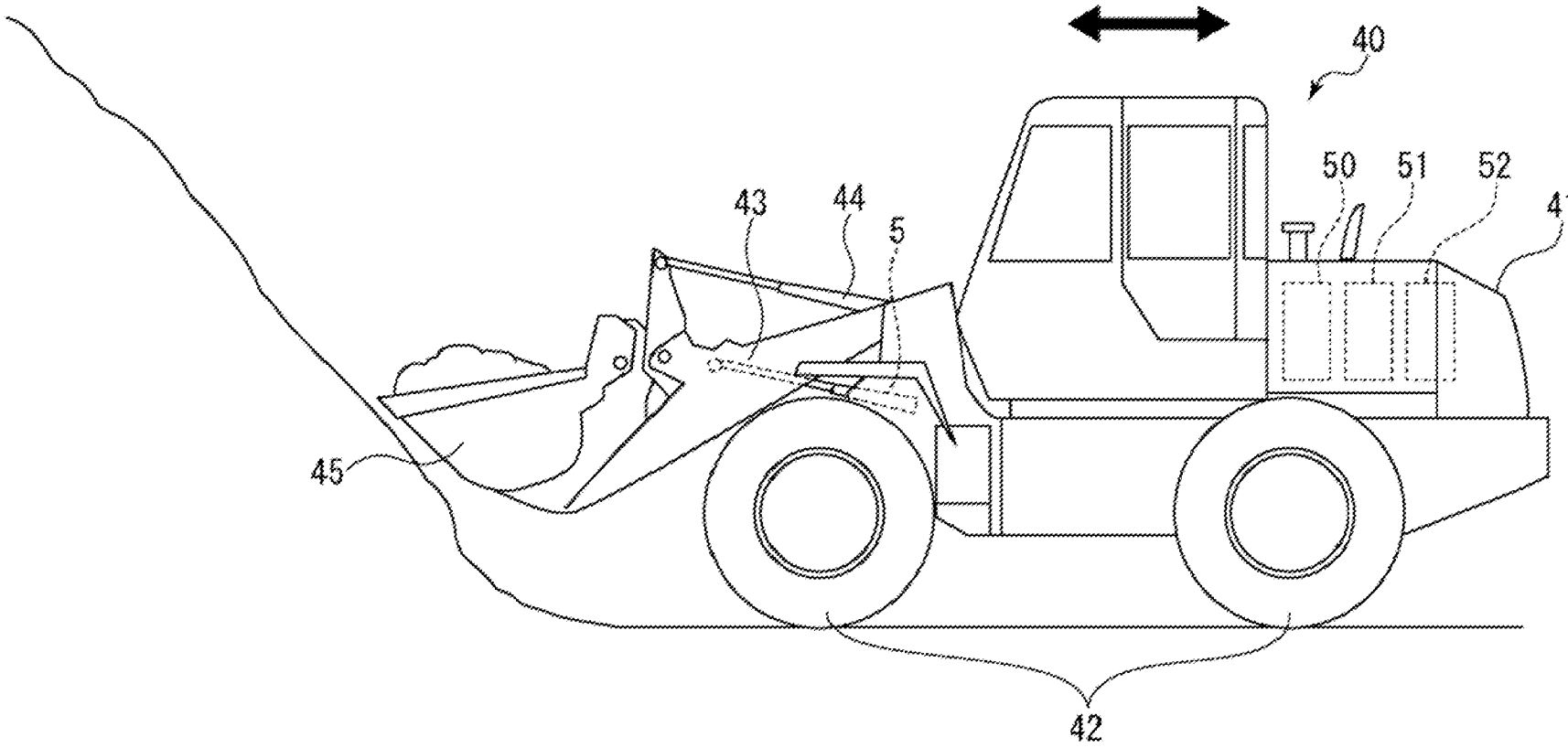
FIG. 1 is a drawing showing a wheel loader in which a hydraulic circuit according to a first embodiment of the present invention is mounted.

Modes for carrying out a fluid pressure circuit according to the present invention will be described below on the basis of the following embodiments.

First Embodiment

A fluid pressure circuit according to a first embodiment of the present invention will be described with reference to FIG. 1 to FIG. 7.

A hydraulic circuit (corresponding to the fluid pressure circuit according to the first embodiment) is configured to control the stroke of a cylinder device in accordance with an operation command for an operating machine, a construction machine, a cargo handling carrying vehicle, an automobile, or the like. For example, the hydraulic circuit is mounted in a power train of a wheel loader 40 shown in FIG. 1. The wheel loader 40 mainly includes a vehicle body 41, driving wheels 42, an operating arm 43, a hydraulic cylinder 44, and a bucket 45 in which gravel or the like is loaded. A driving source 50 such as an engine, a driving fluid circuit 51, a hydraulic cylinder 44, and an operating hydraulic circuit 52 configured to drive a hydraulic cylinder 5 (corresponding to a cylinder device) or the like are provided in the vehicle body 41.

Figure 2:
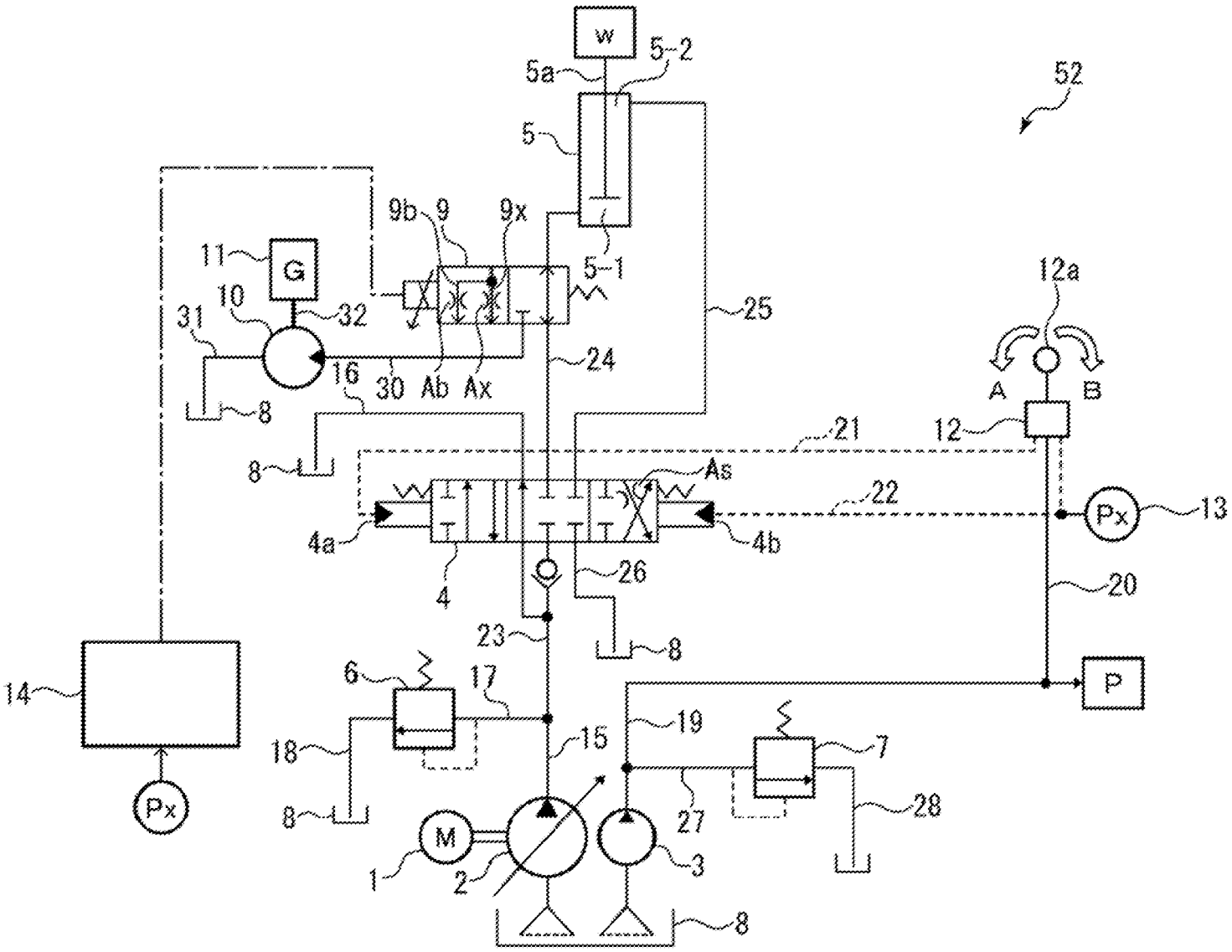
FIG. 2 is a drawing showing the hydraulic circuit according to the first embodiment of the present invention.

As shown in FIG. 2, the hydraulic circuit 52 includes a main hydraulic pump 2 (corresponding to a fluid pressure actuator) configured to be driven by a drive mechanism 1 such as an engine or an electric motor, a pilot hydraulic pump 3, a flow control valve 4, the hydraulic cylinder 5, a relief valve 6, a relief valve 7, a tank 8, a variable regeneration switching valve 9, a regenerative motor 10, a generator 11, a remote control valve 12, a pressure sensor 13, a controller 14, and further oil passages 15 to 31.

The main hydraulic pump 2 is connected to the drive mechanism 1 such as an internal combustion engine and is configured to be rotated by power from the drive mechanism 1 and thereby supplies pressure oil downstream through the oil passage 15.

The pressure oil pumped out from the main hydraulic pump 2 flows through the oil passage 15 into the flow control valve 4. The flow control valve 4 is an open center switching valve having six ports and three positions, and the entire volume of the pressure oil pumped out from the main hydraulic pump 2 flows through the oil passage 16 into the tank 8 in a state where a spool is in a neutral position.

Also, the relief valve 6 is arranged in a main circuit including the main hydraulic pump 2 in order to prevent oil units in the circuit from being damaged when a rod 5*a* of the hydraulic cylinder 5 has reached an extension end or a retraction end or when a load is suddenly applied to the hydraulic cylinder 5 and therefore oil in the circuit is brought into a blocked state to be abnormally high pressure. The relief valve 6 allows the high-pressure oil to be discharged through the oil passages 17 and 18 to the tank 8.

Next, the pilot hydraulic pump 3 is connected to the drive mechanism 1 in the same way as the main hydraulic pump 2 and is configured to be rotated by power from the drive mechanism 1 and thereby supplies the pressure oil downstream through the oil passage 19. Here, part of the pressure oil supplied downstream through the oil passage 19 flows through the oil passage 20 to be supplied to the remote control valve 12.

Figure 3:
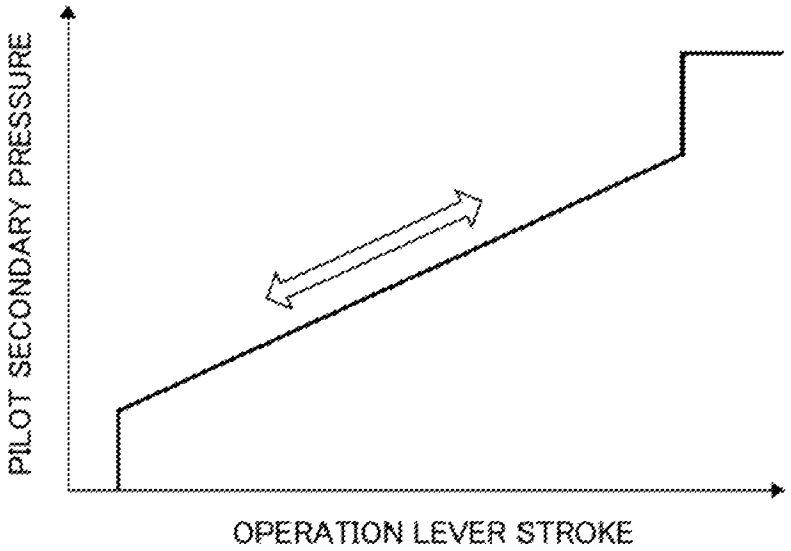
FIG. 3 is a graph showing the relationship between an operation lever stroke and pilot secondary pressure in the first embodiment.

The remote control valve 12 is a variable pressure reducing valve. When an operation lever 12*a* operates the rod 5*a* of the hydraulic cylinder 5 in an extending direction A or in a retracting direction B, the remote control valve 12 supplies pilot secondary pressure, which is proportional to the operation lever stroke of the operation lever 12*a* as shown in FIG. 3, through the signal oil passage 21 to a signal port 4*a* of the flow control valve 4 or through the signal oil passage 22 to a signal port 4*b* of the flow control valve 4, thereby controlling an extended position (or an extension amount) or a retracted position (or a retraction amount) of the rod 5*a*. In addition, the amount of operation of the operation lever 12*a* is substantially equal to the stroke of the operation lever 12*a* and is referred to as the operation lever stroke.

The operation lever 12*a* of the remote control valve 12 is operated in the extending direction A to switch the flow control valve 4 to the extended position. Therefore, the pressure oil from the main hydraulic pump 2 flows through the oil passage 23 and the oil passage 24 into a bottom chamber 5-1 of the hydraulic cylinder 5. Thereafter, the oil in a rod chamber 5-2 flows through the oil passage 25 and then is discharged via the flow control valve 4 though the oil passage 26 to the tank 8. Consequently, the rod 5*a* of the hydraulic cylinder 5 operates in the extending direction.

Meanwhile, the operation lever 12*a* of the remote control valve 12 is operated in the retracting direction B to switch the flow control valve 4 to the retracted position. Therefore, the pressure oil from the main hydraulic pump 2 flows through the oil passage 23 and the oil passage 25 into the rod chamber 5-2 of the hydraulic cylinder 5, and the oil in the bottom chamber 5-1 flows through the oil passage 24 and then is discharged via the flow control valve 4 through the oil passage 26 to the tank 8. Consequently, the rod 5*a* of the hydraulic cylinder 5 operates in the retracting direction.

As shown in FIG. 3, the remote control valve 12 outputs pilot secondary pressure proportionally increased as the operation lever stroke of the operation lever 12*a* of the remote control valve 12 increases. The flow control valve 4 is configured such that a spool (not shown) of the flow control valve 4 strokes substantially in proportion to the pilot secondary pressure of the remote control valve 12. As shown by P-T opening characteristics in FIG. 4, the flow control valve 4 has opening characteristics such that the opening area of throttles between the main hydraulic pump 2 and the hydraulic cylinder 5 increases in accordance with the spool stroke. Accordingly, the volume of the pressure oil supplied to the hydraulic cylinder 5 increases as the amount of opening increases and therefore the operation speed of the rod 5*a* of the hydraulic cylinder 5 increases. That is, the rod speed can be controlled in accordance with the operation lever stroke of the operation lever 12*a* of the remote control valve 12.

In addition, in a case where a load W acts on the hydraulic cylinder 5 in the gravity direction as shown in FIG. 2, the rod speed is dominantly controlled in accordance with C-T opening characteristics shown by the opening area of the throttles between the hydraulic cylinder 5 and the tank 8 as shown in FIG. A. A variable throttle As (corresponding to a first throttle) is provided in a flow passage that connects the oil passage 24 of the flow control valve 4 to the oil passage 26 of the flow control valve 4. The reference symbol As also represents the opening area of the variable throttle As. The flow is throttled by the variable throttle As and thus the operation speed of the rod 5*a* due to the load W can be slower.

Also, in a pilot circuit including the pilot hydraulic pump 3, the relief valve 7 is arranged in order to control the maximum pressure in the circuit. When the operation lever 12*a* of the remote control valve 12 is in a neutral position, the pressure oil is discharged through the oil passage 27 and the oil passage 28 to the tank 8.

The variable regeneration switching valve 9 is arranged in the oil passage 24. When the variable regeneration switching valve 9 is in a neutral position (corresponding to a position at the time of non-regeneration), the oil in the bottom chamber 5-1 of the hydraulic cylinder 5 flows through the oil passage 24 and the entire volume is further discharged via the flow control valve 4 through the oil passage 26 to the tank 8.

The variable regeneration switching valve 9 is a normally-open electromagnetic proportional throttle valve having three ports and two positions. The variable regeneration switching valve 9 includes a flow passage 9*x* functioning in a switched position (corresponding to a position at the time of regeneration) to be connected to the oil passage 24 and a flow passage 9*b* branched from the oil passage 24 to be connected to the oil passage 30. A variable throttle Ab (corresponding to a second throttle) is provided in the flow passage 9*b* to be connected to the oil passage 30. The reference symbol Ab also represents the opening area of the variable throttle Ab, and a variable throttle Ax (corresponding to a third throttle) is provided in the flow passage 9*x* to be connected to the oil passage 24. The reference symbol Ax also represents the opening area of the variable throttle Ax.

When the variable regeneration switching valve 9 switches from the neutral position to a position in which the oil flow is branched into the oil passage 24 and the oil passage 30, the flow of a portion of the return oil from the bottom chamber 5-1 of the hydraulic cylinder 5 is throttled by the variable throttle Ab that is provided in a flow passage to be connected to the oil passage 30, thereafter flowing into the oil passage 30. In addition, the flow of the remaining return oil is throttled by the variable throttle Ax that is provided in the flow passage 9*x* to be connected to the oil passage 24, thereafter being further throttled by the variable throttle As of the flow control valve 4 downward of the variable throttle Ax and being discharged to the tank 8.

Also, the pressure sensor 13 is arranged in the signal oil passage 22. When the operation lever 12*a* of the remote control valve 12 is operated in the retracting direction B, pilot secondary pressure is generated in the signal oil passage 22 and therefore an electric signal is input from the pressure sensor 13 to the controller 14. When the electric signal is input to the controller 14 and electricity storage is required, an electric signal is output from an arithmetic circuit, which is preliminarily integrated in the controller 14, to the variable regeneration switching valve 9, and then the variable regeneration switching valve 9 switches to the position in which the oil flow is branched into the oil passage 24 and the oil passage 30. When a capacitor (not shown) has not reached an allowable electricity storage amount, the controller 14 controls the variable regeneration switching valve 9 to be switched at the same time as when the flow control valve 4 is switched. The variable regeneration switching valve 9 is switched and thereby a portion of the return oil flows via the variable regeneration switching valve 9 through the oil passage 30 into the regenerative motor 10. Therefore, the regenerative motor 10 rotates to allow the generator 11 to generate electricity.

Figure 5:
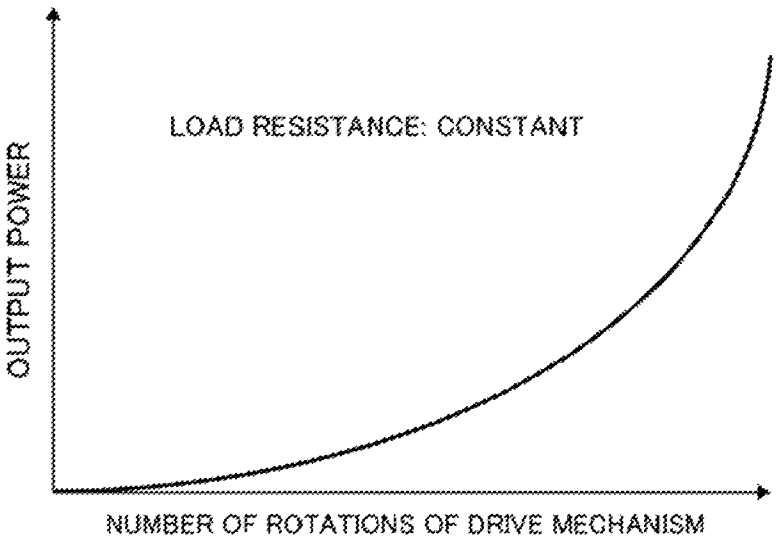
FIG. 5 is a graph shoeing the relationship between the number of rotations of a drive mechanism and output power of a generator in the first embodiment.
Figure 6:
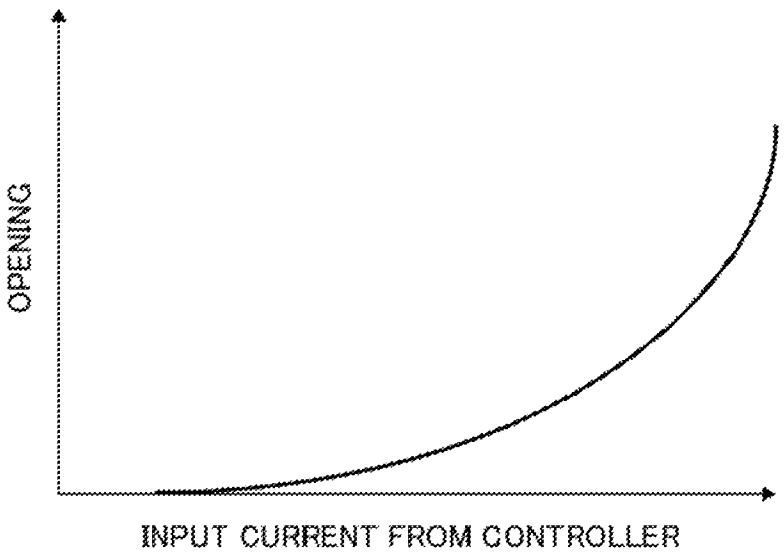
FIG. 6 is a graph showing the relationship between an input current from a controller and opening of throttles of variable regeneration switching valve in the first embodiment.
Figure 7:
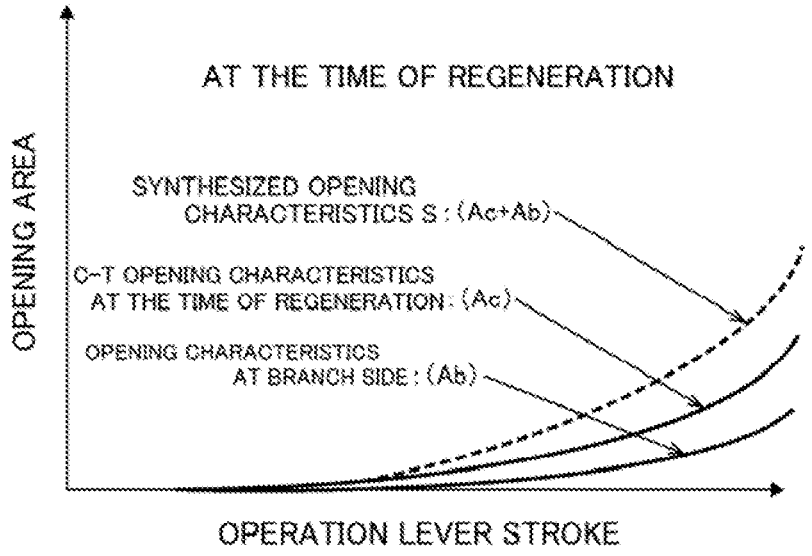
FIG. 7 is a graph showing the relationship between the operation lever stroke and the opening area of the throttles in the first embodiment.
Figure 7:
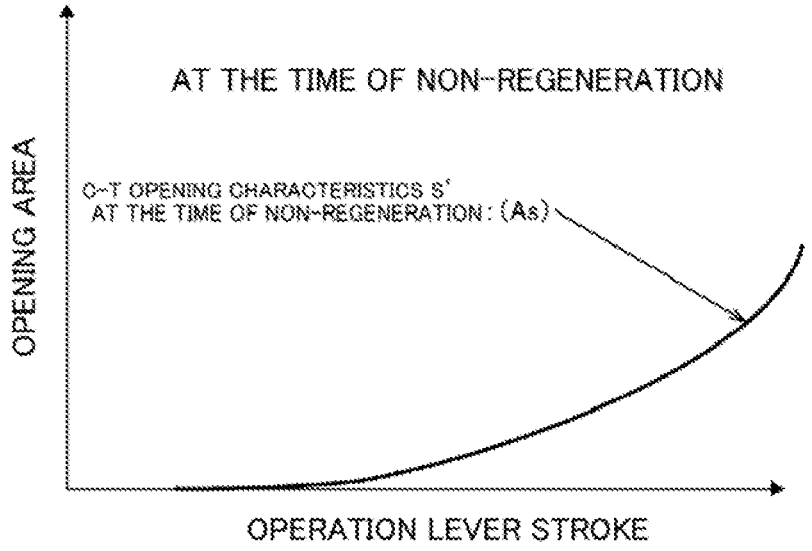

The generator 11 is connected via a connection portion 32 to the regenerative motor 10 and is configured to output electricity with output characteristics shown in FIG. 5 in accordance with the number of rotations of the drive mechanism such as the regenerative motor 10. Also, as shown in FIG. 6, an input current from the controller 14 proportionally increases or decreases in accordance with the amount of operation of the operation lever 12*a* in the retracting direction B, and the variable regeneration switching valve 9 is configured to variably control the opening of the variable throttle Ax of the flow passage 9*x* to be connected to the oil passage 30 in accordance with the input current, and the opening of the variable throttle Ab of the flow passage 9*b* to be connected to the oil passage 24 in accordance with the input current.

Figure 4:
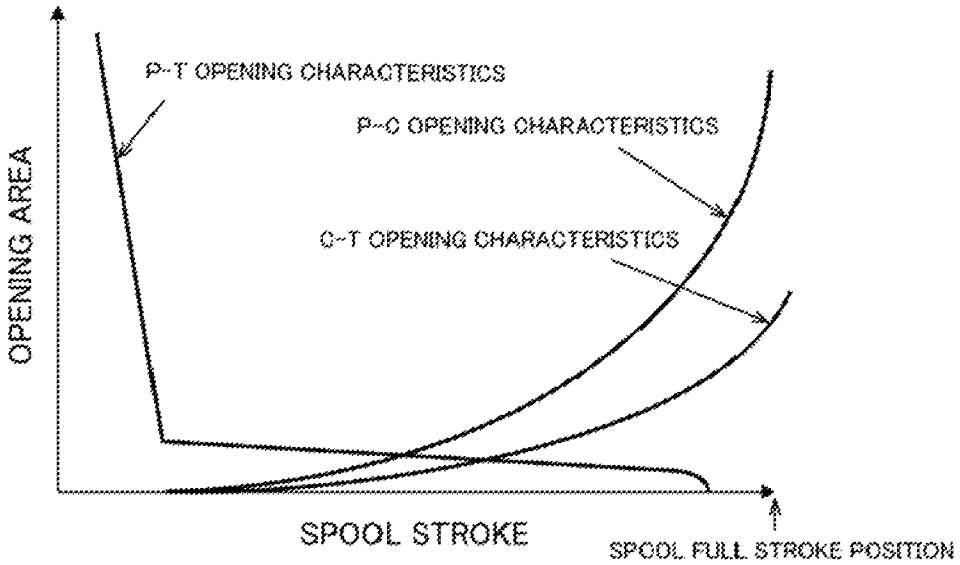
FIG. 4 is a graph showing the relationship between a spool stroke of a flow control valve and opening area of throttles in the first embodiment.

In a case, as mentioned above, where the load W acts on the hydraulic cylinder S in the gravity direction as shown in FIG. 2, the rod speed of the hydraulic cylinder 5 is dominantly controlled by the C-T opening characteristics in FIG. 4. However, in a state where the variable regeneration switching valve 9 is switched to the position in which the oil flow is branched into the oil passage 24 and the oil passage 30, the C-T opening characteristics as well as the throttle opening of the variable throttle Ab provided in the flow passage 9*b* of the variable regeneration switching valve 9 to be connected to the oil passage 30 and the throttle opening of the variable throttle Ax provided in the flow passage 9*x* of the variable regeneration switching valve 9 to be connected to the oil passage 24 are highly involved with the control for the cylinder rod speed. In other words, in a state where the variable regeneration switching valve 9 is switched to the regeneration position, the rod speed is dominantly controlled by a synthesized opening characteristics curve S, shown in FIG. 7A, of the opening characteristics of the flow control valve 4 and the opening characteristics of the variable regeneration switching valve 9. The opening characteristics will be described in detail below.

Also, when the amount of electricity generated by the generator 11 has reached the allowable electricity storage amount of the capacitor (not shown), an electric signal from the controller 14 to the variable regeneration switching valve 9 is cut off. Such cutting-off of the electric signal allows the variable regeneration switching valve 9 to return to the neutral position and a flow passage connected to the oil passage 30 is closed; therefore, the input to the regenerative motor 10 is cut and the generator 11 is stopped. Consequently, a non-regeneration state where electric generation is not performed is generated.

When the amount of electricity generated by the generator 11 has reached the allowable electricity storage amount of the capacitor as mentioned above, the input to the regenerative motor 10 is cut by the controller 14; therefore, the return oil is discharged only via the variable throttle As of the flow control valve 4 to the tank.

In the hydraulic circuit 52 of the first embodiment as mentioned above, the variable regeneration switching valve 9 includes: the flow passage 9*b* to be connected to the oil passage 30 including the variable throttle Ab (i.e., the second throttle) that allows the return oil to be branched and supplied to the regenerative motor 10 at the time of regeneration; and the flow passage 9*x* to be connected to the oil passage 24 including the variable throttle Ax (i.e., the third throttle) that is connected, at the time of regeneration, in series with the variable throttle As (i.e., the first throttle) provided in the flow control valve 4. At the time of regeneration, a portion of the return oil is branched and the flow of the remaining return oil is limited by the variable throttle Ax provided in the flow passage to be connected to the oil passage 24 and by the variable throttle As provided in the flow control valve 4.

Accordingly, in a state where the return oil is branched to be supplied to the regenerative motor 10, when the variable regeneration switching valve 9 is switched from the regeneration position to the non-regeneration position, the opening area of the throttles affecting the return oil from the hydraulic cylinder 5 through the oil passage 24 is changed from a synthesized opening area in a state where the variable throttle Ab and the variable throttle Ax are in parallel connection with each other and the variable throttle Ax is connected in series with the variable throttle As, to a solo opening area in a state where the flow of the return oil is limited by one throttle, i.e., the variable throttle As. This means that a difference of the opening area of the throttles affecting the return oil from the hydraulic cylinder 5, between before and after the switching from the regeneration to the non-regeneration can be reduced. Consequently, a rod of the hydraulic cylinder 5 can be smoothly controlled.

Also, among the variable throttle Ab provided in the flow passage 9*b* of the variable regeneration switching valve 9, the variable throttle Ax provided in the passage 9*x* to be connected to the oil passage 24, and the variable throttle As of the flow control valve 4, the following relational equations are established for the respective opening characteristics.

First, since the variable throttle Ax is arranged in series with the variable throttle As, the following equation is established according to an equation of a synthesized throttle Ac.

$$\text{Synthesized throttle: } Ac=Ax\cdot As/\sqrt{(Ax^2+As^2)} \qquad \text{Equation (1)}$$

In addition, the following equations (2), (3) are established where an equivalent throttle between the variable regeneration switching valve 9 and the flow control valve 4 on a curved line of the C-T opening characteristics from the hydraulic cylinder 5 to the tank 8 is At.

When the variable regeneration switching valve 9 is in the neutral position, i.e., the non-regeneration position, $$At=As \qquad \text{Equation (2); and}$$

when the variable regeneration switching valve 9 is switched to the regeneration position, $$At=Ac+Ab \qquad \text{Equation (3).}$$

Thus, the variable throttle Ax is set so that the foregoing equivalent throttles At are equal even when the variable regeneration switching valve 9 is in the neutral position or in the position in which the oil flow is branched into the oil passage 24 and the oil passage 30. Therefore, as shown in FIGS. 7A and 7B, the opening characteristics (Ac+Ab) of the synthesized opening characteristics curve S at the time of regeneration of the C-T opening characteristics (Ac) and the opening characteristics (Ab) at the branch side of the variable regeneration switching valve 9, and the opening characteristics (As) of an opening characteristics curve S' at the time of non-regeneration can be always constant.

That is, the variable throttle Ax is set so that the following equation (4) is established from the equation (2) and the equation (3).

$$As=Ac+Ab \quad \text{Equation (4)}$$

Therefore, the following equation (5) is derived from the equation (1) and the equation (2).

$$Ax=Ax\cdot(As-Ab)/\sqrt{(Ab\cdot(2\times As-Ab))} \quad \text{Equation (5)}$$

Thus, the synthesized opening characteristics curve S at the time of regeneration can be substantially equal to the opening characteristics curve S' at the time of non-regeneration, and the rod 5*a* can be smoothly controlled.

Further, the variable throttle Ax positioned in series with the variable throttle As of the flow control valve 4 is provided in the variable regeneration switching valve 9 that is a different position from the flow control valve 4; therefore, the variable throttle Ax can be set without depending on the configuration of the flow control valve 4. Consequently, the variable throttle Ax can be applied to a hydraulic circuit including various flow control valves. In particular, since it is difficult for a spool valve that only characteristics of a portion of a valve member are changed, such an effect is remarkable.

Furthermore, when the regenerative motor 10 is driven as described above, the controller 14 switches the flow control valve 4 and the variable regeneration switching valve 9 at the same time. Accordingly, during regeneration by the regenerative motor 10, the regeneration is finished. Also, regeneration is rarely started from a non-regeneration state. Therefore, the variable regeneration switching valve 9 is rarely switched while the rod 5*a* is moving, and thus the rod speed of the hydraulic cylinder 5 can be smoothly controlled.

In addition, if the opening areas As, Ax and Ab the variable throttle As, the variable throttle Ax, and the variable throttle Ab are set to have the relationship of As>Ax>Ab, a difference between the opening characteristics at the time of regeneration and the opening characteristics at the time of non-regeneration can be significantly reduced while the synthesized opening characteristics curve S at the time of regeneration is not substantially equal to the opening characteristics curve S' at the time of non-regeneration.

Second Embodiment

Figure 8:
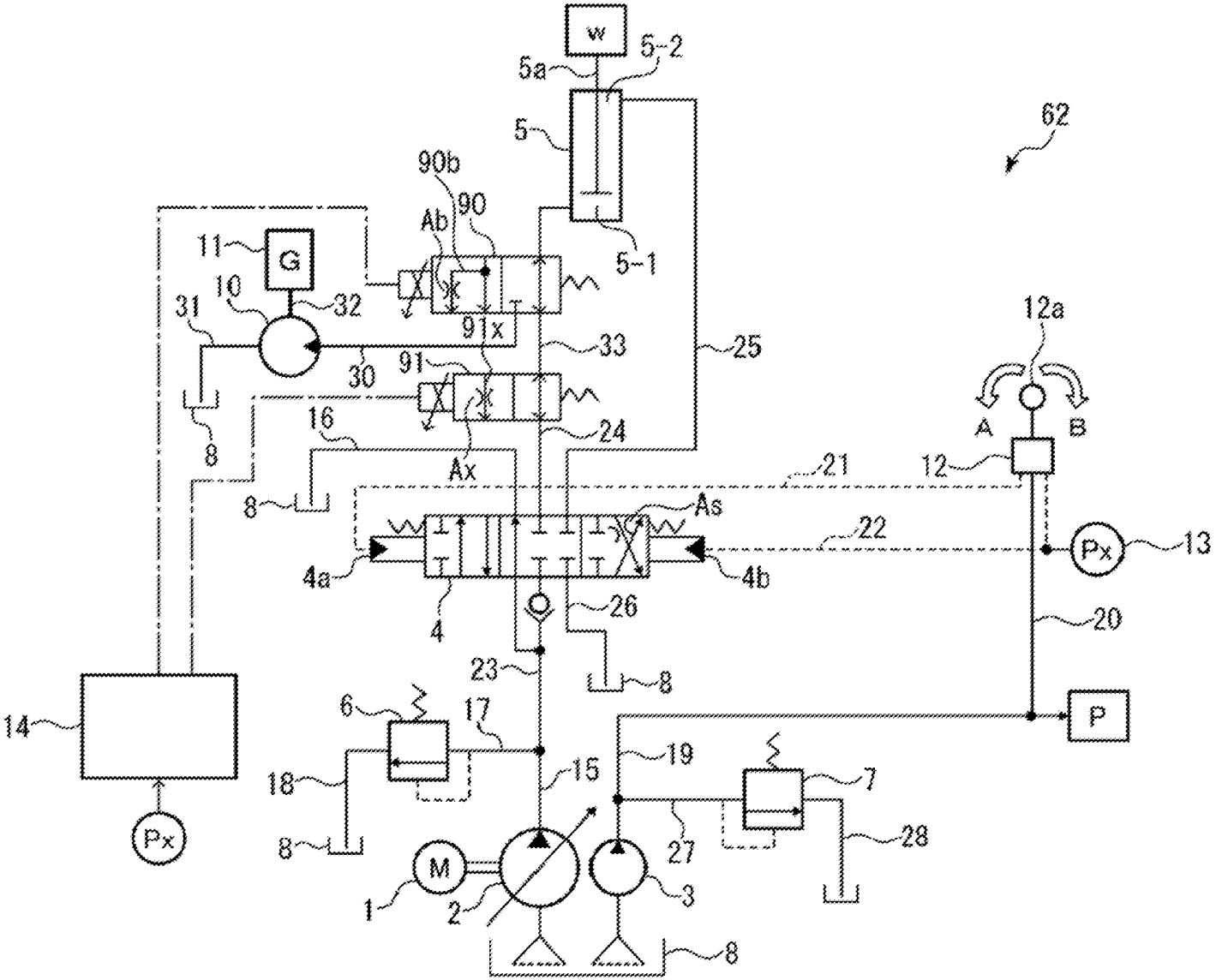
FIG. 8 is a drawing showing a hydraulic circuit according to a second embodiment of the present invention.

Next, a hydraulic circuit 62 according to a second embodiment of the present invention will be described with reference to FIG. 8. Descriptions of configurations of the second embodiment, which are the same as and overlapped with the configurations of the first embodiment will be omitted. That is, the relationship of the opening characteristics is the same and therefore the description thereof will be omitted.

Figure 10:
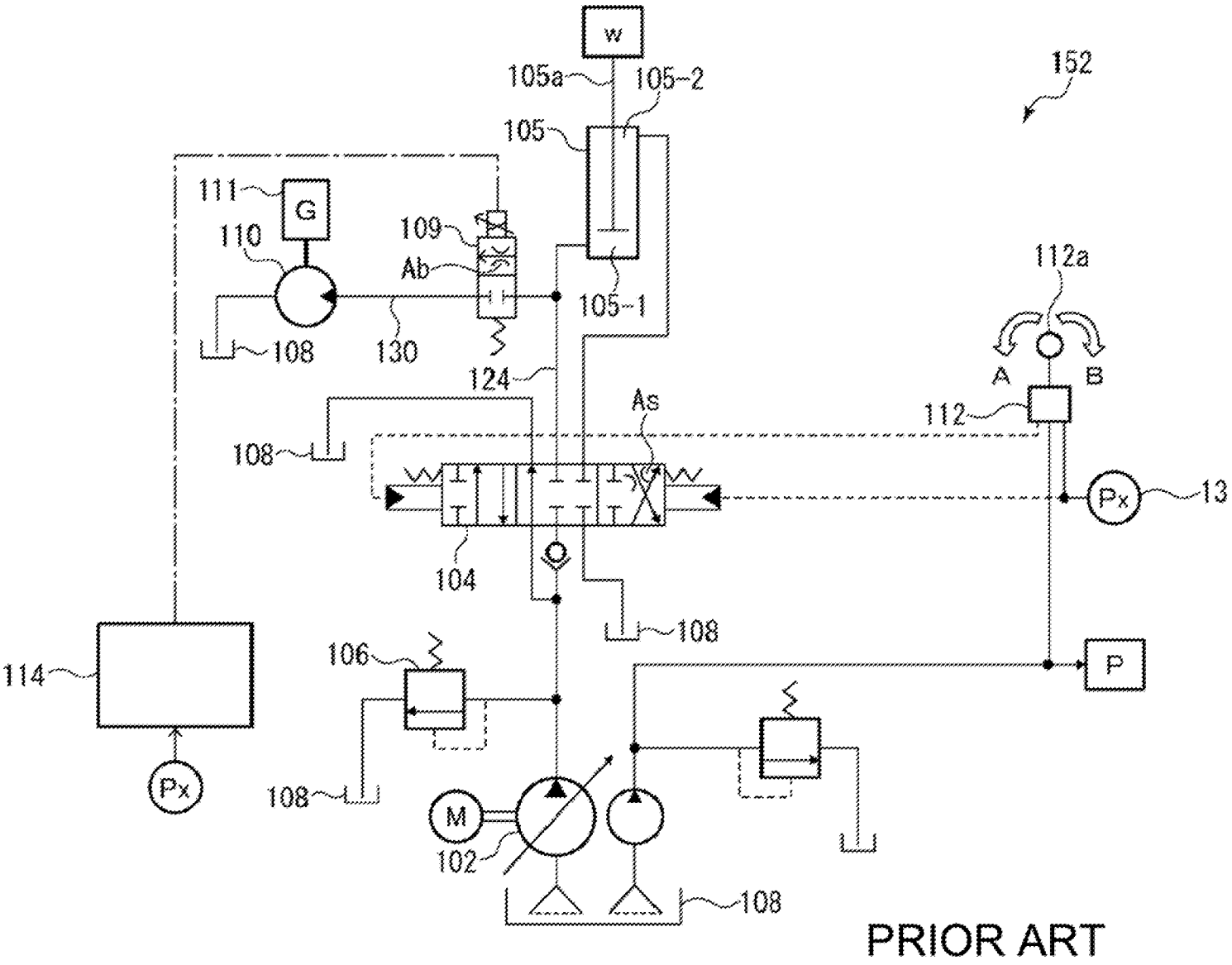
FIG. 10 is a drawing showing a conventional hydraulic circuit.
Figure 11:
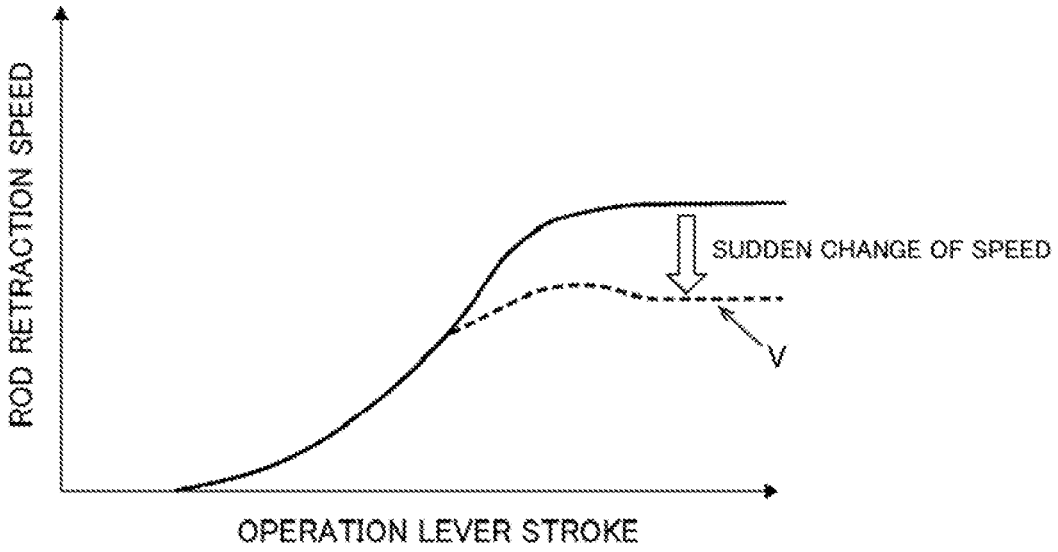
FIG. 11 is a graph showing the relationship between the operation lever stroke and the retraction speed of a rod in the conventional hydraulic circuit.

In the hydraulic circuit 62 shown in FIG. 6, a variable regeneration switching valve 90 and a variable regeneration switching valve 91 are separately provided in the oil passage 24. The variable regeneration switching valve 90 includes a flow passage 90*b* to be connected to the oil passage 30 including the variable throttle Ab (i.e., the second throttle) via which return oil is branched to be supplied to the regenerative motor 10 at the time of regeneration. The variable regeneration switching valve 91 includes a flow passage 91*x* to be connected to the oil passage 24 including the variable throttle Ax (i.e., the third throttle) that is connected, at the time of regeneration, in series with the variable throttle As (i.e., the first throttle) provided in the flow control valve 4. The variable regeneration switching valve 90 is connected to the variable regeneration switching valve 91 by an oil passage 33. According to such a configuration, the variable regeneration switching valve 91 including a flow passage to be connected to the oil passage 24 is additionally provided in a hydraulic circuit 152 (see FIG. 10) as described in the prior art. Therefore, the specification can be easily changed so that a difference between the synthesized opening characteristics curve S at the time of regeneration and the solo opening characteristics curve S' at the time of non-regeneration can be reduced.

Third Embodiment

Next, a hydraulic circuit 63 according to a third embodiment of the present invention will be described with reference to FIG. 9. Descriptions of configurations of the third embodiment, which are the same as and overlapped with the configurations of the first and second embodiments will be omitted.

Figure 9:
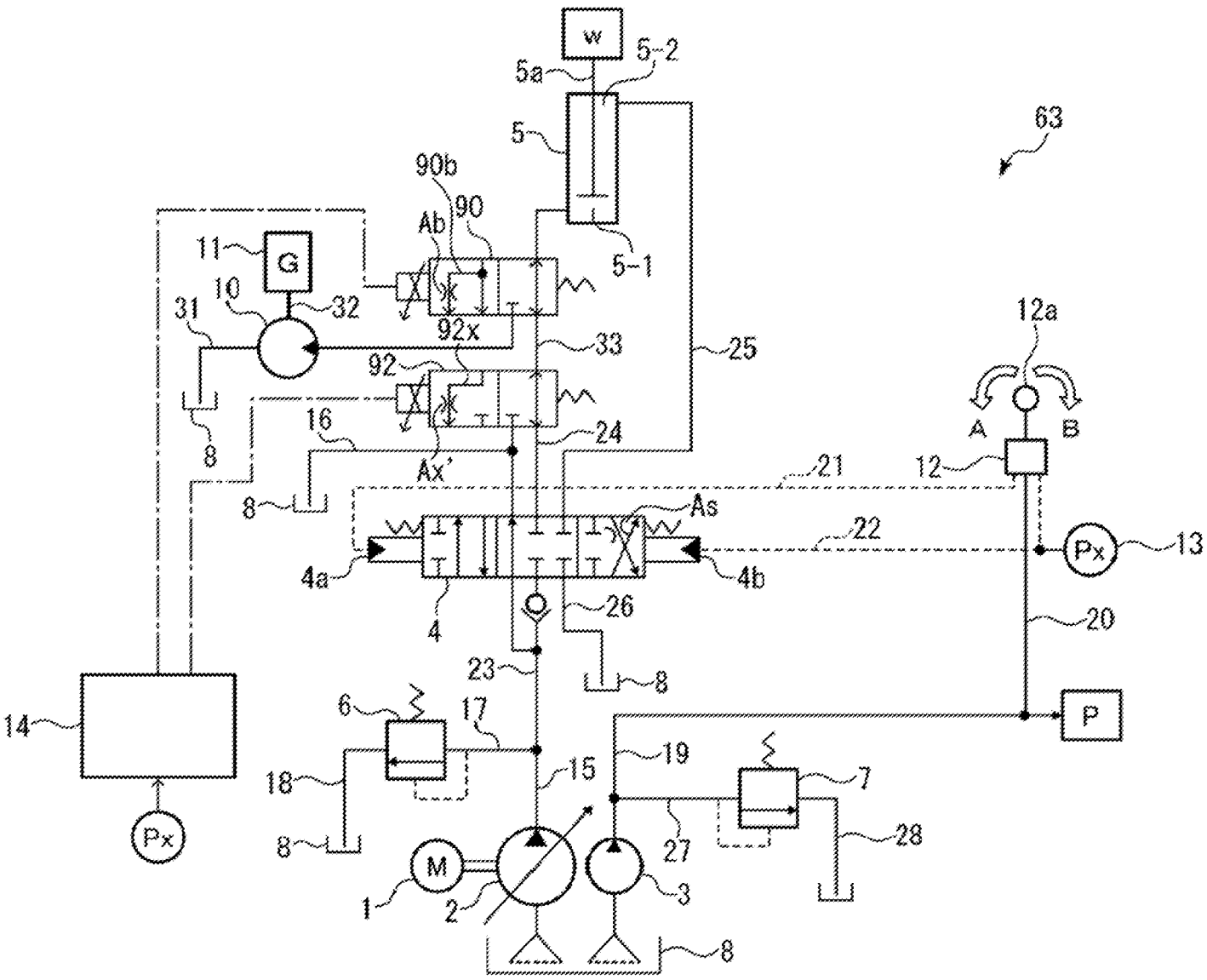
FIG. 9 is a drawing showing a hydraulic circuit according to a third embodiment of the present invention.

In the hydraulic circuit 63 shown in FIG. 9, the variable regeneration switching valve 90 including the variable throttle Ab (i.e., the second throttle) and a variable regeneration switching valve 92 including a variable throttle Ax' (i.e., the third throttle) are separately provided in the oil passage 24. The variable regeneration switching valve 90 is connected to the variable regeneration switching valve 92 by the oil passage 33. The variable regeneration switching valve 92 includes a flow passage 92*x* that is configured to, at the time of regeneration, connect the oil passage 33 and the oil passage 16 through which pressure oil is discharged to the tank 8. In addition, the variable regeneration switching valve 92 is configured to, at the time of the regeneration, close the oil passage 24 downstream of the variable regeneration switching valve 92. Therefore, at the time of the regeneration, the remaining return oil not be supplied to the generative motor 10 is discharged to the tank 8 while not flowing through the flow control valve 4. In this case, the variable throttle Ax' is set to be substantially the same value as the synthesized throttle Ac (i.e., synthesized throttles Ax and As arranged in series) of the first embodiment; thereby, the opening characteristics at the time of regeneration is substantially equal to the opening characteristics at the time of non-regeneration.

The embodiments of the present invention are described as above on the basis of the drawings, but are not limited thereto. Even modifications or additions made to the embodiments within a range not departing from the scope of the present invention may be included in the present invention.

For example, the configuration where the variable throttle Ax positioned in series with the variable throttle As of the flow control valve 4 is provided is described in the foregoing embodiments, but the present invention is not limited to such a configuration. Alternatively, for example, the controller 14 is configured to adjust the variable throttle As of the flow control valve 4 at the time of regeneration so that the synthesized opening characteristics of the opening characteristics at the time of regeneration of the variable throttle As of the flow control valve 4 and the opening characteristics of the variable throttle Ab is substantially equal to the opening characteristics of the variable throttle As at the time of non-regeneration; thereby, the variable throttle Ax of the variable regeneration switching valve 9 may be omitted.

Also, the variable regeneration switching valve 9, 90, 91 or 92 is described as an electromagnetic proportional throttle valve including the variable throttle Ab and the variable throttle Ax or Ax' but is not limited to the electromagnetic proportional throttle valve. Alternatively, the variable regeneration switching valve 9, 90, 91 or 92 may be, for example, a manual flow control valve, a hydraulic flow control valve configured to be controlled by pilot secondary pressure, or a fixed throttle.

Further, the flow control valve 4 may not be hydraulically operated and may be an electromagnetic proportional throttle valve.

Furthermore, oil is described as an example of fluid for the fluid pressure circuit in the foregoing embodiments. Obviously, the present invention may be applied to all kinds of fluids such as water or air. Moreover, a fluid pressure actuator configured to pressurize fluid in a tank is not limited to a hydraulic pump, and the fluid pressure actuator may be variously changed in accordance with fluid used in a fluid pressure circuit and may be, for example, an air cylinder, an accumulator, or the like.

In addition, a case in which from a regeneration state where return oil is branched to be supplied to the regenerative motor 10, the variable regeneration switching valve 9 in the position at the time of regeneration is switched to the position at the time of non-regeneration is mainly described as an example in the foregoing embodiments, but the present invention is not limited to such a case. Alternatively, it is obvious that even when the variable regeneration switching valve 9 is switched from the position at the time of non-regeneration to the position at the time of regeneration, the hydraulic circuit of the present invention can inhibit the rod speed of the hydraulic cylinder 5 from suddenly changing and can smoothly control the rod 5*a*.

REFERENCE SIGNS LIST

1 drive mechanism
2 main hydraulic pump (fluid pressure actuator)
3 pilot hydraulic pump
4 flow control valve
5 hydraulic cylinder (cylinder device)
5*a* rod
8 tank
9 variable regeneration switching valve
10 regenerative motor
11 generator
12 remote control valve
12*a* operation lever
13 pressure sensor
14 controller
15 to 30 oil passage
33 oil passage
40 wheel loader
52 hydraulic circuit

The invention claimed is:

1. A fluid pressure circuit for controlling a rod stroke of a cylinder device in accordance with an operation command, the fluid pressure circuit comprising:

a tank having a fluid stored therein;

a fluid pressure actuator configured to pressurize the fluid supplied from the tank for extending and retracting the cylinder device;

a flow control valve arranged between the fluid pressure actuator and the cylinder device and configured to switch a flow passage of the pressurized fluid and to discharge via a first throttle the fluid returned from the cylinder device;

a variable regeneration switching valve configured to discharge the fluid returned from the cylinder device to the flow control valve upon non-regeneration of fluid energy and to, upon regeneration of the fluid energy, branch part of the fluid returned from the cylinder device and discharge via a second throttle the fluid branched;

a regenerative motor configured to be driven for the regeneration by the fluid branched by the variable regeneration switching valve; and a third throttle configured to be connected in series with the first throttle upon the regeneration to limit flow of the fluid returned from the cylinder device, wherein As>Ax>Ab, where As, Ab, and Ax are an opening area of the first throttle, an opening area of the second throttle, and an opening area of the third throttle, respectively, for the operation command.

2. The fluid pressure circuit according to claim 1, wherein the third throttle is provided separately from the flow control valve.

3. The fluid pressure circuit according to claim 2, wherein the third throttle is provided in the variable regeneration switching valve.

4. The fluid pressure circuit according to claim 2, wherein when driving the regenerative motor, the flow control valve and the variable regeneration switching valve are simultaneously switched.

5. The fluid pressure circuit according to claim 2, wherein the flow control valve is a spool switching valve having six ports and three positions.

6. A fluid pressure circuit for controlling a rod stroke of a cylinder device in accordance with an operation command, the fluid pressure circuit comprising:

a tank having a fluid stored therein;

a fluid pressure actuator configured to pressurize the fluid supplied from the tank for extending and retracting the cylinder device;

a flow control valve arranged between the fluid pressure actuator and the cylinder device and configured to switch a flow passage of the pressurized fluid and to discharge via a first throttle the fluid returned from the cylinder device;

a variable regeneration switching valve configured to discharge the fluid returned from the cylinder device to the flow control valve upon non-regeneration of fluid energy and to, upon regeneration of the fluid energy, branch part of the fluid returned from the cylinder device and discharge via a second throttle the fluid branched;

a regenerative motor configured to be driven for the regeneration by the fluid branched by the variable regeneration switching valve; and a third throttle configured to be connected in series with the first throttle upon the regeneration to limit flow of the fluid returned from the cylinder device, wherein $Ax=As\cdot(As-Ab)/\sqrt{(Ab\cdot(2\times As-Ab))}$, where As, Ab, and Ax are an opening area of the first throttle, an opening area of the second throttle, and an opening area of the third throttle, respectively, for the operation command.

7. The fluid pressure circuit according to claim 6, wherein the third throttle is provided separately from the flow control valve.

8. The fluid pressure circuit according to claim 7, wherein the third throttle is provided in the variable regeneration switching valve.

9. The fluid pressure circuit according to claim 7, wherein when driving the regenerative motor, the flow control valve and the variable regeneration switching valve are simultaneously switched.

10. The fluid pressure circuit according to claim 8, wherein the flow control valve is a spool switching valve having six ports and three positions.

* * * * *